US009636743B2

(12) United States Patent
Mochizuki

(10) Patent No.: US 9,636,743 B2
(45) Date of Patent: May 2, 2017

(54) DUAL-CHAMBERED MOLTEN METAL HOLDING FURNACE FOR LOW PRESSURE CASTING

(71) Applicant: TOUNETSU CO., LTD., Shizuoka (JP)

(72) Inventor: Kiyata Mochizuki, Fujinomiya (JP)

(73) Assignee: TOUNETSU CO., LTD., Fujinomiya-Shi (JP)

( * ) Notice: Subject to any disclaimer, the term of this patent is extended or adjusted under 35 U.S.C. 154(b) by 0 days.

(21) Appl. No.: 14/896,614

(22) PCT Filed: Jul. 17, 2014

(86) PCT No.: PCT/JP2014/068987

§ 371 (c)(1),
(2) Date: Dec. 7, 2015

(87) PCT Pub. No.: WO2016/009522

PCT Pub. Date: Jan. 21, 2016

(65) Prior Publication Data

US 2016/0199906 A1 Jul. 14, 2016

(51) Int. Cl.
*B22D 18/04* (2006.01)
*B22D 35/04* (2006.01)
(Continued)

(52) U.S. Cl.
CPC ..... *B22D 18/04* (2013.01); *B22D 35/04* (2013.01); *B22D 41/005* (2013.01); *B22D 41/02* (2013.01); *B22D 41/22* (2013.01)

(58) Field of Classification Search
CPC ..... B22D 18/04; B22D 35/04; B22D 41/005; B22D 41/02; B22D 41/22
(Continued)

(56) References Cited

U.S. PATENT DOCUMENTS

2006/0169435 A1 8/2006 Bend
2014/0144561 A1* 5/2014 Shin et al. ..... B22D 15/02 148/698

FOREIGN PATENT DOCUMENTS

CN 2 579 565 10/2003
CN 101 094 740 12/2007
(Continued)

OTHER PUBLICATIONS

Machine translation of JP 2007-313547 A.*

*Primary Examiner* — Kevin P Kerns
(74) *Attorney, Agent, or Firm* — Fay Kaplun & Marcin, LLP

(57) ABSTRACT

A dual-chambered molten metal holding furnace is for low pressure casting; producing cast products such as aluminum alloys using a low pressure casting method; and prevention of the gas release to the molten metal and the occurrence of air bubbles in the molten metal even when pressurized gas enters a material constituting the molten metal storage container. The part of a pressurizing chamber excluding a pressurizing pipe and a molten metal output pipe is opened to the atmosphere via an air passage gap positioned above a fixed molten metal surface level position L3. The air passage gap is positioned above the fixed molten metal surface level position L3. Even if pressurized gas is seeped into the material constituting a molten metal storage container via cracks or cracking subsequently occurred in the pressurizing pipe or minute gap originally present in the pressurizing pipe, the pressurized gas seeped from the air passage gap is released to the outside of the furnace.

6 Claims, 6 Drawing Sheets

(51) Int. Cl.
*B22D 41/22* (2006.01)
*B22D 41/005* (2006.01)
*B22D 41/02* (2006.01)

(58) Field of Classification Search
USPC ..... 164/284, 303
See application file for complete search history.

(56) References Cited

FOREIGN PATENT DOCUMENTS

| | | |
|---|---|---|
| JP | 11-188476 | 7/1999 |
| JP | 2006142886 | 6/2006 |
| JP | 2007-313547 | 12/2007 |
| JP | 2011-502787 | 1/2011 |
| KR | 20-0461523 | 7/2012 |

* cited by examiner

DUAL-CHAMBERED MOLTEN METAL HOLDING FURNACE FOR LOW PRESSURE CASTING

PRIORITY CLAIM

This application is a national stage application, filed under 35 U.S.C. §371, of PCT Patent Application Serial No. PCT/JP2014/068987 filed on Jul. 17, 2014, entitled "Dual-Chambered Molten Metal Holding Furnace For Low Pressure Casting", which is hereby incorporated by reference in its entirety.

BACKGROUND OF THE INVENTION

Field of the Invention

The present invention relates to a dual-chambered molten metal holding furnace for low pressure casting that is preferable for producing cast products such as aluminum alloys by means of the low pressure casting method.

Description of the Related Art

A dual-chambered molten metal holding furnace for low pressure casting including a molten metal storage container that partitions a molten metal holding chamber and a pressurizing chamber on the inside thereof and is formed of a monolithic refractory material; a cover plate made of a steel product that covers a bottom surface, a side surface, and a top surface of the molten metal storage container via a heat insulation layer and/or a fireproof layer around its circumference; a molten metal passage opening that is provided between the molten metal holding chamber and the pressurizing chamber; a lifting cutoff valve that opens and closes the molten metal passage opening; and tube heaters that are placed, respectively, in the interior of the molten metal holding chamber and the interior of the pressurizing chamber, wherein the pressurizing chamber includes a pressurizing part and a molten metal output part which are communicated with each other at the bottom thereof, a pressurizing pipe and a molten metal output pipe, each of which is a heat-resistant integral sintered product having impermeability and molded from fine ceramics or the like, are mounted inside the pressurizing part and the molten metal output part, respectively, is known (see Patent Document 1 with the applicant being the same as the present applicant). Although the monolithic refractory material constituting the molten metal storage container is permeable, an upper space of the molten metal surface level in the pressurizing chamber is in a completely sealed structure by the impermeable pressurizing pipe so as to take measures for seeping the molten metal into the molten metal storage container.

A heat-resistant integral sintered product molded from a material having permeability to some extent has been employed as each of the pressurizing pipe and the molten metal output pipe. In this case, since the pressurizing pipe and the molten metal output pipe exhibit a slight permeability, pressurized gas enters a material constituting the molten metal storage container from the pressurizing pipe. After the pressurized gas is held in the material for some time, the pressurized gas is released again in the molten metal, resulting in generation of air bubbles in the molten metal and defective products. Thus, in the technique disclosed in Patent Document 1, impermeability obtained by employing fine ceramics or the like which may be very expensive as a material is intended to prevent entry of pressurized gas into the material constituting the molten metal storage container from the pressurizing pipe and generation of air bubbles in the molten metal in association with reemission of the pressurized gas.

PRIOR ART DOCUMENTS

Patent Documents

[Patent Document 1] Japanese Patent No. 4519806

SUMMARY OF THE INVENTION

Problems to be Solved by the Invention

If cracks or cracking occurs in the pressurizing pipe due to physical impact upon maintenance or the like, expansion and contraction with change in temperature, and other causes in spite of the fact that an upper space of the molten metal surface level in the pressurizing chamber is in a completely sealed structure by using impermeable members such as fine ceramics as the pressurizing pipe and the molten metal output pipe disclosed in Patent Document 1, the pressurizing pipe loses its impermeability, which brings entry of pressurized gas into the material constituting the molten metal storage container from the pressurizing pipe during pressurization. Consequently, the gas entered into the material constituting the molten metal storage container is held for some time and then is released into the molten metal, resulting in generation of air bubbles in the molten metal. Air bubbles generated in the molten metal may cause defective products such as voids in the castings.

The pressurizing pipe and the molten metal output pipe of which the main component is alumina or the like instead of fine ceramics having impermeability exhibit a slight permeability but not sufficient as a monolithic refractory material constituting the molten metal storage container therearound. Hence, pressurized gas may be seeped/held from the pressurizing pipe to the porous material part of the molten metal storage container from the beginning, which may cause defective products such as voids due to release of pressurized gas from the molten metal storage container into the molten metal.

The present invention has been made in view of the aforementioned circumstances, and an object of the present invention is to prevent release of the gas to the molten metal and the occurrence of air bubbles in the molten metal by releasing the pressurized gas from the molten metal storage container to the outside of the furnace even when the pressurized gas enters a material constituting the molten metal storage container from the pressurizing pipe.

Means for Solving the Problems

The dual-chambered molten metal holding furnace for low pressure casting of the present invention includes a molten metal storage container that partitions a molten metal holding chamber and a pressurizing chamber on the inside thereof and is formed of a monolithic refractory material; a cover plate made of a steel product that covers a bottom surface, a side surface, and a top surface of the molten metal storage container via a heat insulation layer and/or a fireproof layer around its circumference; a molten metal passage opening that is provided between the molten metal holding chamber and the pressurizing chamber; a lifting cutoff valve that opens and closes the molten metal passage opening; and tube heaters that are placed, respectively, in the interior of the molten metal holding chamber and the interior of the pressurizing chamber, wherein the pressurizing chamber includes a pressurizing part and a molten metal output part which are communicated with each other at the bottom thereof, a pressurizing pipe and a molten metal output pipe, each of which is a heat-resistant integral sintered product molded from a material having impermeability or permeability to some extent, are mounted inside the pressurizing part and the molten metal output part, respectively, the remaining part of the molten metal storage container is opened to the atmosphere via an air passage part positioned above the fixed molten metal surface level position, whereby, even when pressurized gas enters a material constituting the molten metal storage container from the inner walls other than the molten metal output pipe and the pressurizing pipe of the pressurizing chamber, the pressurized gas is released to the outside of the furnace by means of the air passage part so as to prevent release of the gas to the molten metal and the occurrence of air bubbles in the molten metal.

The top surface covering part of the molten metal output part is screwed to the side surface covering part of the molten metal storage container in the cover plate with bolts or the like at appropriate intervals, so that an air passage part can be configured as a gap between the side surface covering part and the top surface covering part. It is preferable that such an air passage part be disposed on the side part of the cover plate on the pressurizing chamber side. As alternative means for screwing the top surface covering part to the side surface covering part, a top surface covering part of the molten metal output part is intermittent-welded to the side surface covering part of the molten metal storage container in the cover plate, so that an air passage part can be configured as a gap between the cover plates in the non-welded part. Apart from this, an opening may be perforated into the cover plate above the fixed molten metal surface level position with provision of socket members or the like so as to perform venting.

Effects of the Invention

According to the present invention, the parts of the molten metal storage container other than the pressurizing pipe and the molten metal output pipe are in communication with the atmosphere via the permeable molten metal storage container, permeability of a heat insulation layer and/or a fireproof layer around its circumference, and the air passage part. Even if pressurized gas leaks from the pressurizing pipe into the monolithic refractory material when the pressurizing pipe which is an impermeable heat-resistant integral sintered product loses its impermeability due to occurrence of cracks or cracking or when the heat-resistant integral sintered product having permeability to some extent is used instead of the impermeable fine ceramics as the pressurizing pipe, the pressurized gas can be released to the outside of the furnace by means of the air passage part. Thus, release of the gas to the molten metal and the occurrence of air bubbles in the molten metal, which may be caused as a result of entry of the pressurized gas from the pressurizing pipe of the pressurizing chamber into the material constituting the molten metal storage container, may be eliminated, resulting in eliminating a cause of defective products. In addition, since the air passage part is disposed above the fixed molten metal surface level position, leakage of the molten metal to the outside in a long span can be avoided by the cover plate made of a steel product (iron skin) provided at the outermost circumference in spite of some permeability of the molten metal storage container and the heat insulation layer and/or the fireproof layer around its circumference.

BEST MODES FOR CARRYING OUT THE INVENTION

Figure 1:
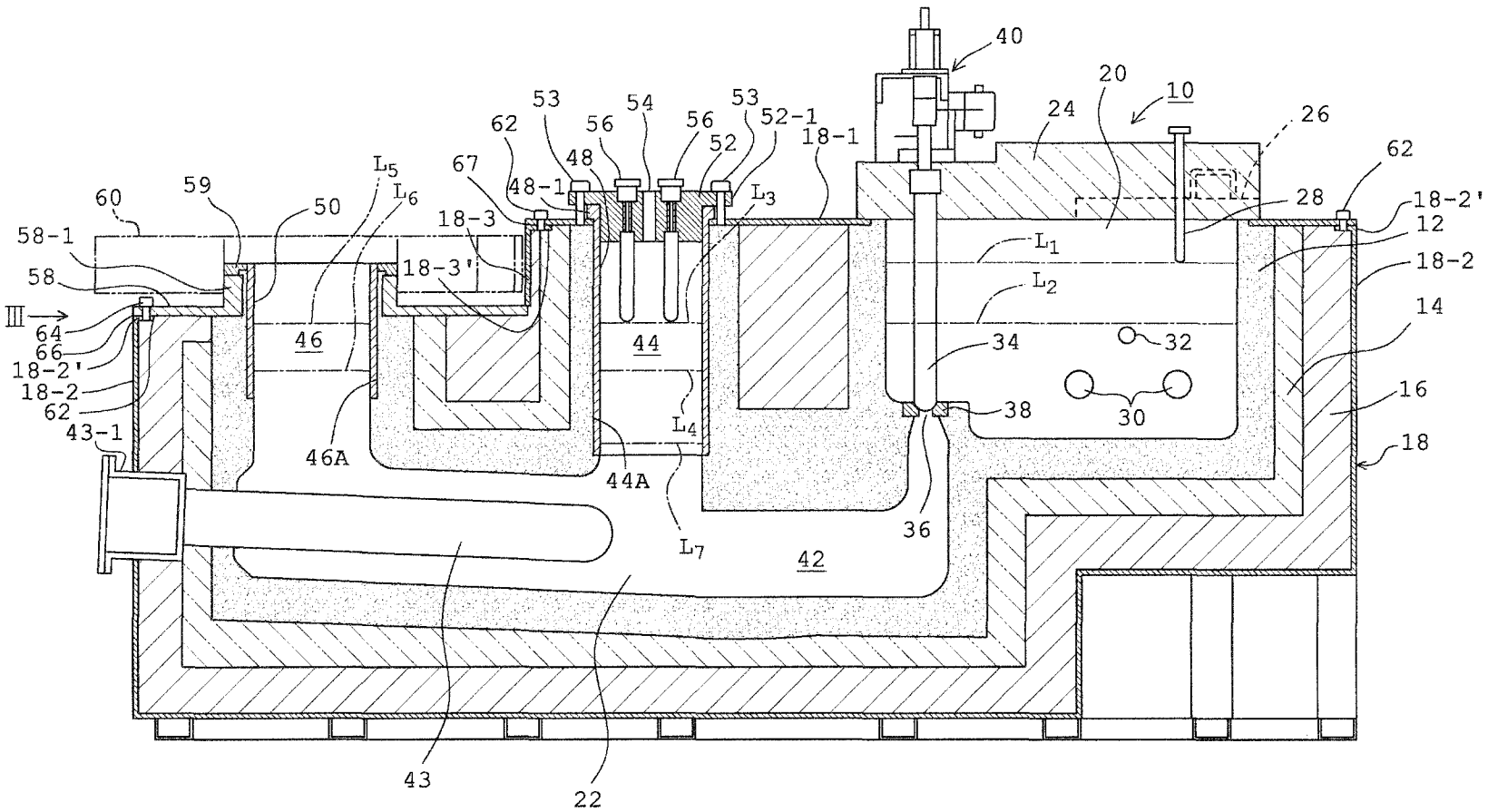
FIG. 1 is a cross-sectional view illustrating a dual-chambered molten metal holding furnace for low pressure casting according to one embodiment of the present invention.
Figure 2:
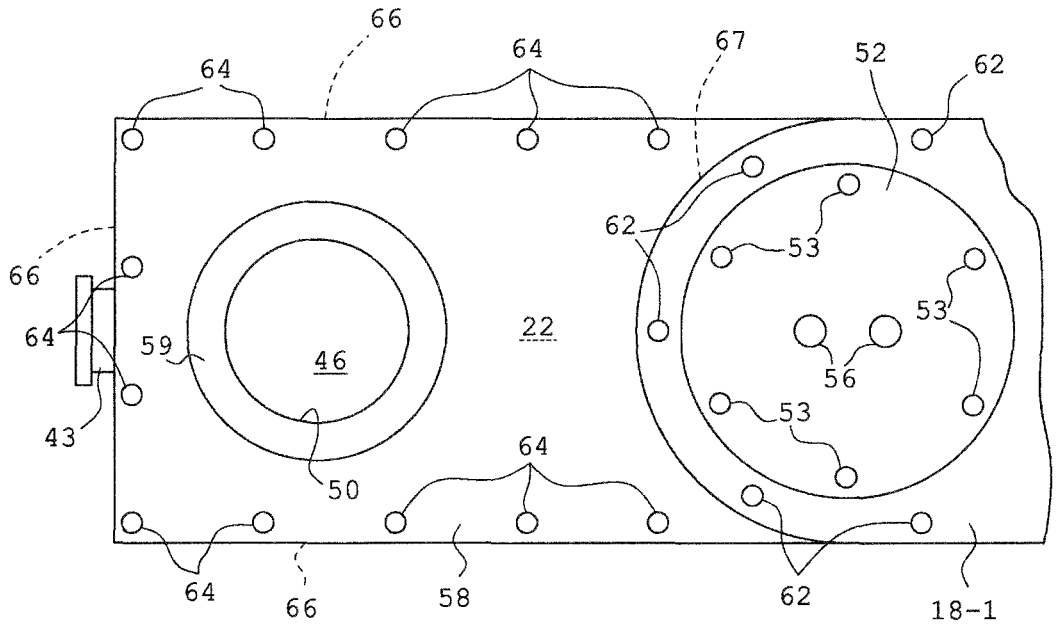
FIG. 2 is a top plan view illustrating the dual-chambered molten metal holding furnace for low pressure casting shown in FIG. 1.

Hereinafter, a description will be given of an embodiment of the present invention with reference to the attached drawings. In FIGS. 1 and 2, the reference numeral 10 denotes the entirety of the dual-chambered molten metal holding furnace for low pressure casting (hereinafter simply referred to as "molten metal holding furnace") according to the present invention. The molten metal holding furnace 10 includes a molten metal storage container 12, and the molten metal storage container 12 is molded by a monolithic refractory material. In this embodiment, the monolithic refractory material which serves as a material for the molten metal storage container 12 is mainly composed of, for example, powder alumina. The powder alumina is kneaded with water, is molded into a predetermined shape (casting), and then is cured and dried.

A fireproof layer 14 and a heat insulation layer 16 reside in this order on the outside of the molten metal storage container 12, the bottom surface and side surfaces and a part of the top surface, all of which are outside the heat insulation layer 16, are firmly covered by an iron skin 18 (a cover plate part for covering side surfaces and a top surface of the molten metal storage container in the cover plate made of a steel product in the present invention). The fireproof layer 14 is composed of a material such as alumina or other refractories, which is kneaded with water in appropriate ratios and then can be molded by molding and drying. The heat insulation layer 16 can be configured by attaching a fire-resistant fabric.

The internal space of the molten metal storage container 12 is partitioned into a molten metal holding chamber 20 and a pressurizing chamber 22. A holding chamber lid 24 is mounted on the upper opening of the molten metal holding chamber 20 and a part of the holding chamber lid 24 is a replenishment opening lid 26 that is capable of being opened and closed to cover the molten metal replenishment opening. A level sensor 28 for detecting the upper-limit molten metal surface level $L_1$ of the molten metal in the molten metal holding chamber 20 is supported in a suspended state by the holding chamber lid 24. The molten metal holding chamber 20 also includes two tube heaters 30 and a temperature sensor 32 at the side wall part thereof. With this arrangement, the molten metal holding chamber 20 can hold the molten metal accumulated therein within a certain temperature range. Note that the lower-limit molten metal surface level in the molten metal holding chamber 20 is shown by a chain-dotted line $L_2$.

A lifting cutoff valve 34 extends vertically in the molten metal holding chamber 20, and the lower end of the lifting cutoff valve 34 is positioned to face a molten metal passage opening 36 disposed between the molten metal holding chamber 20 and the pressurizing chamber 22, and the molten metal passage opening 36 can be opened and closed by the lifting cutoff valve 34. In other words, a valve seat 38 is securely-attached to the molten metal passage opening 36 so that the inflow of molten metal from the molten metal holding chamber 20 to the pressurizing chamber 22 is prevented when the lifting cutoff valve 34 is seated to the valve seat 38 and the inflow of molten metal from the molten metal holding chamber 20 to the pressurizing chamber 22 is permitted when the lifting cutoff valve 34 lifts from the valve seat 38. The upper end of the lifting cutoff valve 34 protrudes outwardly through the holding chamber lid 24, and the lifting cutoff valve 34 is connected to a lifting drive mechanism 40 in a pneumatic system or the like for controlling the opening and closing operations of the lifting cutoff valve 34.

The pressurizing chamber 22 includes a pressurizing part 44 and a molten metal output part 46 which are communicated with each other at the bottom thereof via a lower flow passage 42 leading to the molten metal passage opening 36. One end 43-1 of a tube heater 43 for maintaining a molten metal temperature in the pressurizing chamber 22 is secured to the furnace wall side, and the other end of the tube heater 43 cantileveredly extend into the lower flow passage 42. Although the number of the molten metal output part 46 is one in FIG. 2, the molten metal output part 46 may also be provided in plural so as to supply molten metal from the common pressurizing part 44.

The pressurizing part 44 and the molten metal output part 46 include tubular members 48 and 50 (hereinafter respectively referred to as "pressurizing pipe" and "molten metal output pipe"), respectively, for covering the inner surface of the molten metal storage container 12. In this embodiment, the pressurizing pipe 48 and the molten metal output pipe 50 are formed by kneading powder fine ceramics or granulated fine ceramics (e.g., silicon nitride) with water and by integral sintering (sintering) after molding. Thus, the pressurizing pipe 48 and the molten metal output pipe 50 are impermeable in this embodiment. Cylindrical recesses 44A and 46A are cut and formed in the inner peripheral surface of the molten metal storage container 12 in the pressurizing part 44 and the molten metal output part 46, and the pressurizing pipe 48 and the molten metal output pipe 50 are intimately fit via a sealing member so as to be flush with the cylindrical recesses 44A and 46A, respectively. The present invention does not exclude the possibility that the pressurizing pipe 48 and the molten metal output pipe 50 exhibit permeability to some extent (a very slight permeability to air remains but not as much as free permeability to air of the molten metal storage container 12) in the embodiment to be described below.

The upper end flange part 48-1 of the pressurizing pipe 48 comes into engagement with the ceiling part 18-1 of the iron skin 18 around the entire periphery thereof and the opening of the pressurizing pipe 48 is sealed with a sealing lid 52 around the entire periphery thereof. In other words, a flange part 52-1 is formed on the outer periphery of the sealing lid 52, a bolt 53 (a bolt with hex hole or the like) is inserted into the flange part 52-1 from above, and the leading end of the bolt 53 is screwed into the ceiling part 18-1 of the iron skin 18. As shown in FIG. 2, the bolts 53 are provided along the entire periphery of the sealing lid 52 at appropriate intervals. A seal is provided for sealing at the interface between the ceiling part 18-1 of the iron skin 18 and the flange part 48-1 and at the interface between the flange part 48-1 and the sealing lid 52. The upper end flange part 48-1 of the pressurizing pipe 48 is clamped between the flange part 52-1 of the sealing lid 52 and the ceiling part 18-1 of the iron skin 18 by the fastening (screwing) bolts 53 via a seal. Thus, the pressurizing part 44 is in a completely sealed structure at a part above the pressurizing pipe 48 in conjunction with the impermeability of the pressurizing pipe 48 consisting of fine ceramics. A pressurized gas passage 54 (to be connected to a pressurized gas source which is not shown) and a pair of level sensors 56 are provided on the sealing lid 52, and a sensing end of each level sensor 56 vertically and cantileveredly extends into the internal cavity of the pressurizing part 44. The fixed molten metal surface level $L_3$ in the pressurizing part 44 is detected by the level sensors 56. The fixed molten metal surface level $L_3$ is set to the same height as the lower-limit molten metal surface level $L_2$ of the molten metal holding chamber 20.

A ceiling plate 58 (the ceiling plate 58 and the ceiling part 18-1 of the iron skin 18 serve as the top surface covering part of the molten metal storage container in the cover plate according to the present invention) made of steel product is provided on the upper wall surface of the furnace at the molten metal output part 46. A boss 58-1 is formed at the center of the ceiling plate 58, the molten metal output pipe 50 is inserted through the boss 58-1, the molten metal output pipe 50 is adapted to protrude somewhat from the boss 58-1, and a die base (shown by a phantom line 60) is connected to the ceiling plate 58 via an annular sealing member 59. A liquid level $L_5$ in the molten metal output part 46 indicates the molten metal liquid level upon completion of preparation for output of molten metal to a die, and the liquid level $L_6$ indicates the molten metal liquid level upon completion of output of molten metal to a die. The molten metal output pipe 50 is positioned so as to extend downwardly below the liquid level $L_6$. A mold (not shown) is secured on the lower die base 60. The mold has a cavity inside thereof corresponding to casting and also has a molten metal communication passage for communicating the cavity to the molten metal output part 46. During the filling of molten metal to the mold at the pressurizing part 44, molten metal is pushed out by applying pressure to the molten metal surface by the pressurized gas introduced from the pressurized gas passage 54 so that the molten metal surface is lowered from the fixed molten metal surface level $L_5$ to the molten metal surface level $L_6$ but the lower end of the molten metal output pipe 50 is positioned below the molten metal surface level $L_6$.

The ceiling plate 58 not only functions as a cover plate that covers the molten metal storage container 12, the fireproof layer 14, and the heat insulation layer 16 on the top surface of the molten metal output part 46 but also functions for die connection. Thus, the ceiling plate 58 is composed of the same steel material as the iron skin 18 but has a significant thickness in order to ensure a required strength. In other words, the ceiling plate 58 extends to the side wall part 18-2 of the iron skin 18 on the one hand, but extends to the side wall part 18-3 that extends vertically downward from the ceiling part 18-1 of the iron skin for covering the top surface of the pressurizing part 44 on the other hand.

A brief description will be given of the supply of molten metal by the molten metal holding furnace 1. Firstly, the replenishment opening lid 26 is open by raising a cutoff valve 34 with the molten metal passage opening 36 being open so as to supply molten metal to the molten metal holding chamber 20. The molten metal supplied to the molten metal holding chamber 20 enters and is stored in the pressurizing chamber 22 via the molten metal passage opening 36. When the level sensors 56 detect that the molten metal surface in the pressurizing part 44 has finally reached the fixed molten metal surface level $L_3$, the molten metal passage opening 36 is closed by lowering the cutoff valve 34. At this time, the molten metal surface in the molten metal output part 46 has also reached the fixed molten metal surface level $L_5$ which is the same height as the fixed molten metal surface level $L_3$. Furthermore, when the level sensor 28 detects that the molten metal surface has reached the upper-limit molten metal surface level $L_1$ by continuing to supply molten metal to the molten metal holding chamber 20, the supply of molten metal is stopped and then the replenishment opening lid 26 is closed. With this arrangement, the casting process becomes ready for execution. Next, in the casting process, pressurized gas (e.g., dry air, N2 gas, Ar gas, or the like) is supplied from the pressurized gas passage 54 into the pressurizing part 44, and then, a pressure of about 0.2 to 0.5 atm is applied to the molten metal surface so as to push upward the molten metal in the molten metal output part 46. Consequently, the molten metal in the molten metal output part 46 is filled into the cavity of the mold. At this time, the molten metal surface in the pressurizing part 44 lowers from the fixed molten metal surface level $L_3$ to the molten metal surface level $L_7$. After the elapse of a predetermined time from the completion of filling the molten metal into the mold, the pressure on the pressurizing part 44 is released to atmospheric pressure via the pressurized gas passage 54. Although this leads to a return of the molten metal to the molten metal output part 46, the molten metal in the molten metal storage container 12 is decreased by the amount required for one casting operation, and thus, the molten metal surfaces in the molten metal output part 46 and the pressurizing part 44 respectively become the molten metal surface levels $L_6$ and $L_4$ which are lower than the fixed molten metal surface levels $L_5$ and $L_3$, respectively. Then, when the molten metal passage opening 36 is open by raising the cutoff valve 34, the molten metal in the molten metal holding chamber 20 enters the pressurizing chamber 22 due to the difference in height between the molten metal surface level in the molten metal holding chamber 20 and that in the pressurizing chamber 22. When the level sensors 56 detect that the molten metal surface level in the pressurizing part 44 has been raised and reached the fixed molten metal surface level $L_3$, the molten metal passage opening 36 is closed by lowering the cutoff valve 34. At this time, the molten metal surface in the molten metal output part 46 has also reached the fixed molten metal surface level $L_5$ which is the same height as the fixed molten metal surface level $L_3$ in the pressurizing part 44. With this arrangement, the next casting process becomes ready for execution. By repetition of the casting process as described above, the molten metal in the molten metal holding chamber 20 is decreased successively and stepwisely. When the molten metal surface in the pressurizing part 44 does not rise to the fixed molten metal surface level $L_3$ by opening the molten metal passage opening 36, the level sensors 56 cannot detect the fixed molten metal surface level $L_3$. Thus, it can be determined that a time period for replenishment of the molten metal is reached, so that the molten metal is automatically or manually replenished in the molten metal holding chamber 20 by opening a molten metal replenishment lid 26.

Figure 3:
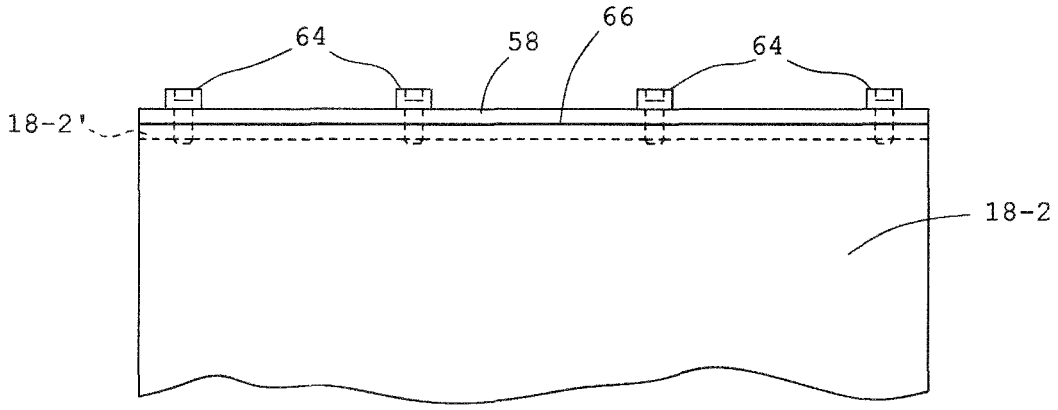
FIG. 3 is a partial side view illustrating the dual-chambered molten metal holding furnace for low pressure casting as viewed from the direction of the arrow of III shown in FIG. 1.

In the above embodiment, the pressurizing part 44 is in a completely sealed structure at a part above the pressurizing pipe 48 but the remaining part of the molten metal storage container 12 is not sealed. In other words, the molten metal storage container 12 is completely covered at its bottom wall part and its side surface part by the iron skin 18 via the fireproof layer 14 and the heat insulation layer 16. However, the ceiling part 18-1 of the iron skin 18 and the side wall parts 18-2 and 18-3 thereof are not in a completely sealed structure. In other words, as shown in FIGS. 1 and 2, the ceiling part 18-1 of the iron skin 18 is simply screwed to the upper ends 18-2' and 18-3' of the side wall parts 18-2 and 18-3, respectively, with bolts (bolts with hex hole or the like) at appropriate intervals and the ceiling part 18-1 of the ceiling plate 58 for covering the top surface of the molten metal storage container 12 around the molten metal output part 46 is also not completely sealed with respect to the side wall part 18-2 but is simply screwed to the side wall part 18-2 with bolts (bolts with hex hole or the like) 64 at appropriate intervals (see FIG. 2). Thus, narrow gaps 66 and 67 (see FIGS. 1 and 2) remain between opposite surfaces of the ceiling part 18-1 of the iron skin 18 and the ceiling plate 58 and the upper end 18-2' of the side wall part 18-2 of the iron skin 18 and between opposite surfaces of the ceiling part 18-1 of the iron skin 18 and the ceiling plate 58 and the upper end 18-3' of the side wall part 18-3 of the iron skin 18, respectively. The gap 66 between the upper end 18-2' of the side wall part 18-2 of the iron skin 18 and the ceiling plate 58 is clearly shown in FIG. 3. Each of these gaps 66 and 67 serves as an air passage part that vents the permeable furnace materials, i.e., the molten metal storage container 12, the fireproof layer 14, and the heat insulation layer 16 to the outside air. In the present invention, the gaps 66 and 67 constituting the air passage part are provided uniformly distributed over substantially the entire side surface part (the iron skin 18) of the cover plate on the pressurizing chamber 22 side (see FIGS. 1 and 2), which is advantageous for the efficient discharge of gas seeped from the pressurizing pipe 48 to the molten metal storage container 12. Such a ventilation structure prevents defective products such as voids due to air bubbles in the molten metal in association with reemission of the pressurized gas when the pressurized gas in the pressurizing pipe 48 is seeped and held to the p membrane material constituting the molten metal storage container 12. In other words, in the present embodiment, the pressurizing pipe 48 is composed of an impermeable member such as a ceramics material, seepage of pressurized gas in the pressurizing pipe 48 toward the membrane material side does not occur under normal circumstances. However, if cracks or cracking occurs in the pressurizing pipe 48 which is the heat-resistant integral sintered product formed of impermeable fine ceramics due to physical impact upon maintenance or the like, and expansion and contraction with change in temperature and the pressurizing pipe 48 loses its impermeability, pressurized gas enters into the molten metal storage container 12 through the pressurizing pipe 48 of the pressurizing chamber 22, the gas entered into the molten metal storage container 12 is held for some time and then is released into the molten metal, resulting in generation of air bubbles in the molten metal. In the present embodiment, seepage of gas from the pressurizing pipe 48 to the molten metal storage container 12 due to a loss of impermeability caused by cracks, cracking or the like occurred in the pressurizing pipe 48 can be avoided by releasing the gas seeped from the air passage gaps 66 and 67 formed by the fact that the ceiling part of the iron skin 18 is screwed to the upper end of the side wall part of the iron skin 18 with bolts at appropriate intervals to the outside of the furnace. Consequently, leakage of the gas to the molten metal and the occurrence of air bubbles in the molten metal, which may be caused as a result of entry of the pressurized gas from the inner walls of the pressurizing chamber into the molten metal storage container 12, are eliminated. In the present embodiment, the pressurized gas entered into the molten metal storage container 12 is released from the air passage gaps 66 and 67 which are gaps formed by screwing, and thus, the pressurized gas entered into the molten metal storage container 12 is not released into the molten metal, resulting in no occurrence of air bubbles, so that a cause of defective products can be eliminated.

Furthermore, since the gap 66 with respect to the iron skin side wall surface 18-2 of the ceiling plate 58 is positioned above the fixed molten metal surface level $L_5$, seepage of the molten metal to the outside via the permeable molten metal holding chamber 20, the fireproof layer 14, and the heat insulation layer 16 can be avoided in a long-term span. Although the flow of the molten metal, of course, crosses the fixed molten metal surface level $L_5$ upon output of the molten metal in the molten metal output part 46, the speed of seepage of the molten metal caused by the permeability of furnace materials is extremely slow, the presence of the gap 66 does not cause seepage of the molten metal in a short-term span such as upon output of the molten metal in the molten metal output part 46.

Figure 4:
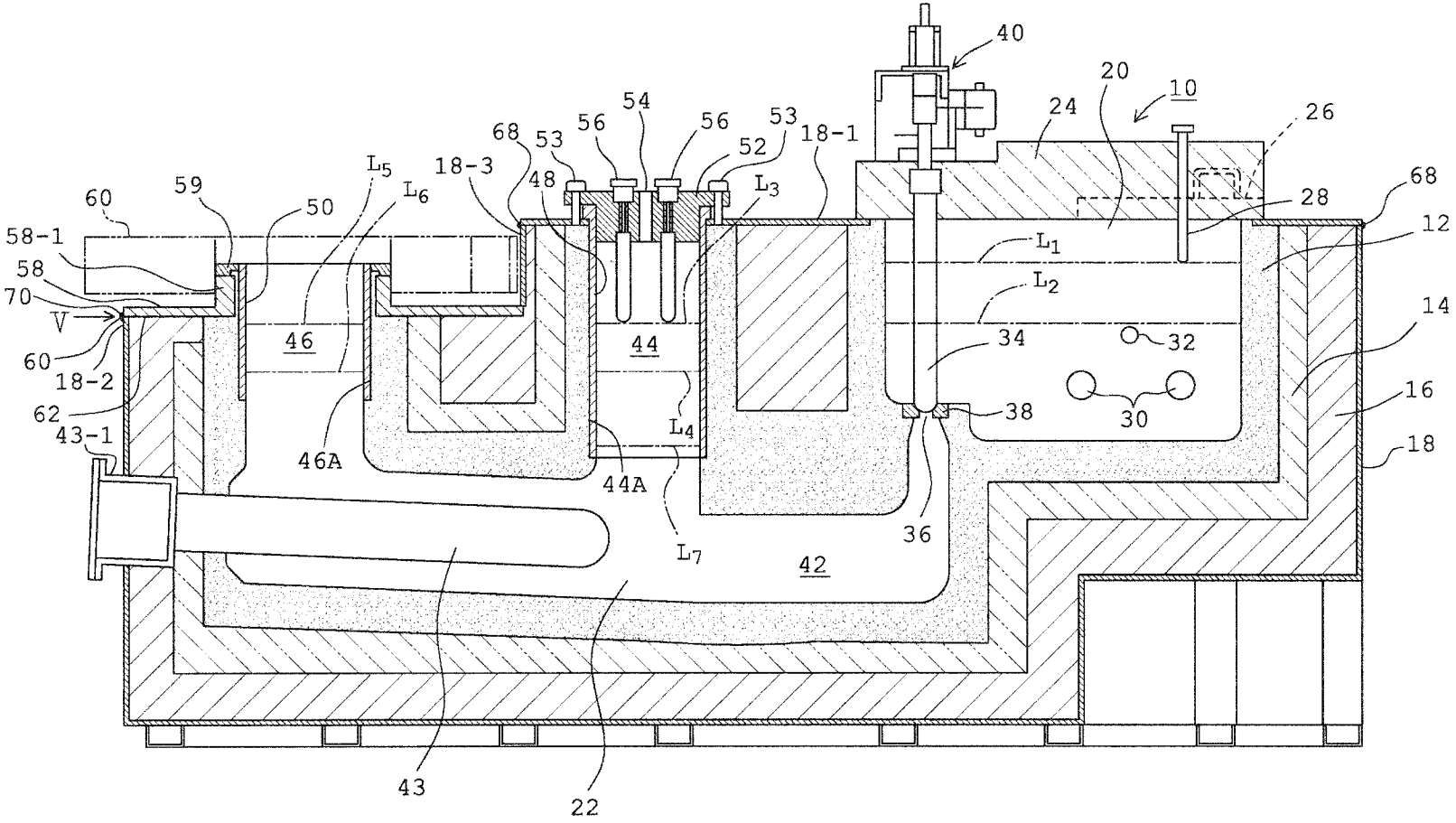
FIG. 4 is a cross-sectional view illustrating a dual-chambered molten metal holding furnace for low pressure casting according to another embodiment of the present invention.
Figure 5:
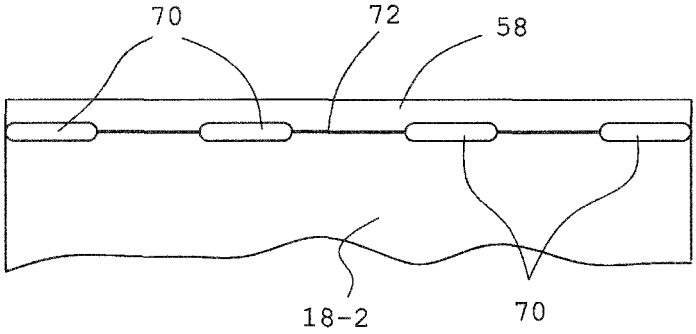
FIG. 5 is a partial side view illustrating the dual-chambered molten metal holding furnace for low pressure casting as viewed from the direction of the arrow of V shown in FIG. 4.

While, in the above embodiment, the parts of the molten metal storage container 12 other than the pressurizing part 44 are vented to the outside air by remaining narrow gaps, between opposite surfaces of the ceiling part 18-1 of the iron skin 18 and the ceiling plate 58 and the side wall part 18-2 of the iron skin 18, formed by screwing with the bolts 62 and 64, intermittent-welding may be used instead of screwing with bolts in the second embodiment. FIG. 4 is a general view illustrating a dual-chambered molten metal holding furnace for low pressure casting according to the second embodiment, the ceiling part 18-1 of the iron skin 18 and the ceiling plate 58 are secured to the side wall part 18-2 of the iron skin 18 with welding parts 68 and 70, respectively, instead of bolts 62 and 64 shown in FIG. 1. This welding is so-called "intermittent-welding" at predetermined intervals, the intermittent-welded parts 70 of the ceiling plate 58 with respect to the upper end of the side wall part 18-2 of the iron skin 18 are shown in FIG. 5, narrow gaps 72 between the ceiling plate 58 and the iron skin side wall surface 18-2 remain between the intermittent-welded parts 70, which serve as air passage parts. Although not illustrated, the same gaps constituting the air passage parts at non-welded parts between the intermittent-welded parts 68 also remain between the ceiling part 18-1 and the side wall part 18-3 of the iron skin 18. In other words, the gaps 72 constituting the air passage parts are disposed over a wide range of the side surface part of the cover plate (the iron skin 18 and the ceiling plate 58) on the pressurizing chamber 22 side, and thus, the gas seeped from the pressurizing pipe 48 to the molten metal storage container 12 can also be efficiently discharged to the outside of the furnace in this embodiment. As in the first embodiment, when the pressurized gas leaks from the pressurizing pipe 48 into the molten metal storage container 12 due to the occurrence of cracks or cracking, the gas is released from the air passage part to the outside of the furnace, so that release of the gas to the molten metal and the occurrence of air bubbles in the molten metal may be prevented.

Figure 6:
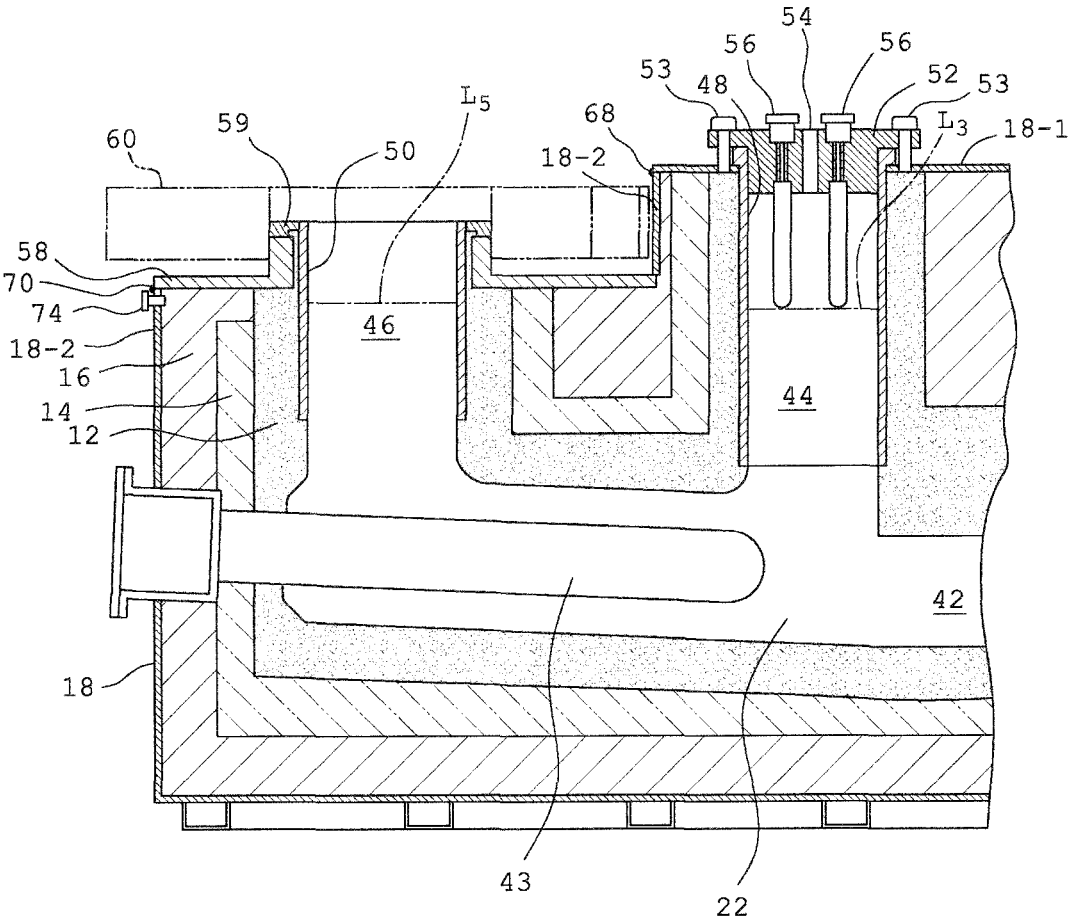
FIG. 6 is a cross-sectional view illustrating an essential part of a dual-chambered molten metal holding furnace for low pressure casting according to still another embodiment of the present invention.

FIG. 6 is a partial view illustrating an essential part of a dual-chambered molten metal holding furnace for low pressure casting according to a third embodiment. Although the ceiling part 18-1 of the iron skin 18 and the ceiling plate 58 are welded with respect to the side wall part 18-2 of the iron skin 18 as in the second embodiment, this welding is applied to the entire periphery thereof, and thus, a socket 74 (hole-formed member) is provided at the side wall 18-2 of the iron skin 18 above the fixed molten metal surface level $L_5$ ($L_3$) for ventilation. The presence of the socket 74 allows a part other than the pressurizing part 44 in the molten metal holding chamber 20 to be opened to the atmosphere due to permeability of furnace materials above the fixed molten metal surface level $L_5$ ($L_3$). Thus, as in the first and second embodiments, when the pressurized gas leaks from the pressurizing pipe 48 into the molten metal storage container 12, the gas is released from the air passage part to the outside of the furnace by the effect of the socket 74, so that release of the pressurized gas to the molten metal and the occurrence of air bubbles in the molten metal may be prevented. As in the gaps 66 and 72 in the first and second embodiments, the socket 74 is also disposed over a wide range of the side surface part of the cover plate (the iron skin 18 and the ceiling plate 58) on the pressurizing chamber 22 side, and thus, the pressurized gas can be efficiently discharged to the outside of the furnace.

While, in the first to third embodiments of the present invention described above, the pressurizing pipe 48 and the molten metal output pipe 50 are composed of fine ceramics as a material, the present invention also encompasses the case, as a fourth embodiment, where the pressurizing pipe 48 and the molten metal output pipe 50 are formed by kneading a fire-resistant powder consisting of alumina, silica, carbon, and the like with water and by integral sintering (sintering) after molding so as to give some permeability to the pressurizing pipe 48 and the molten metal output pipe 50. In other words, since a completely sealed structure is not obtained in this case, seepage of pressurized gas may occur from the pressurizing pipe 48 to the porous membrane material part from the beginning. The provision of air passage parts (the gaps 66, 67, and 72 and the socket 74) having the same structure as in the first to third embodiments where the pressurizing pipe 48 and the molten metal output pipe 50 exhibit impermeability allows gas to be released to the outside of the furnace via the air passage parts even if seepage of gas occurs from the pressurizing pipe 48 to the molten metal storage container 12, so that the occurrence of defective products may be avoided.

REFERENCE NUMERALS

12: molten metal storage container
20: molten metal holding chamber
22: pressurizing chamber
24: holding chamber lid
26: replenishment opening lid
28: level sensor
30: tube heater
34: cutoff valve
36: molten metal passage opening
42: lower flow passage
46: molten metal output part
48: pressurizing pipe
50: molten metal output pipe

52: sealing lid
54: passage for pressurized gas
56: level sensor
58: ceiling plate
60: lower die base
62 and 64: bolt
66, 67, and 72: air passage gap
74: ventilation socket

What is claimed is:

1. A dual-chambered molten metal holding furnace for a low pressure casting, comprising:

a molten metal storage container partitioning a molten metal holding chamber and a pressurizing chamber on an inside thereof and is formed of a monolithic refractory material;

a cover plate composed of a steel product that covers a bottom surface, a side surface, and a top surface of the molten metal storage container via a heat insulation layer and/or a fireproof layer around the circumference of the molten metal storage container;

a molten metal passage opening provided between the molten metal holding chamber and the pressurizing chamber;

a lifting cutoff valve opening and closing the molten metal passage opening; and tube heaters placed, respectively, in the interior of the molten metal holding chamber and the interior of the pressurizing chamber, wherein the pressurizing chamber comprises a pressurizing part and a molten metal output part which are communicated with each other at the bottom thereof, a pressurizing pipe and a molten metal output pipe, each of which is a heat-resistant integral sintered product molded from a material having impermeability or permeability, are mounted inside the pressurizing part and the molten metal output part, respectively, a part of the molten metal storage container other than the pressurizing part is opened to the atmosphere via an air passage part positioned above the fixed molten metal surface level position, whereby, even when pressurized gas enters a material constituting the molten metal storage container from the pressurizing pipe, the pressurized gas is released to the outside of the furnace using the air passage part so as to prevent release of the gas to the molten metal and the occurrence of air bubbles in the molten metal.

2. The furnace according to claim 1, wherein the air passage part is disposed on the sides of the cover plate on a pressurizing chamber side.

3. The furnace according to claim 1, wherein a top surface covering part in the cover plate comprises fixing parts fixed at appropriate intervals with respect to a side surface covering part of the molten metal storage container in the cover plate, and a gap between facing surfaces of the side surface covering part and the top surface covering part between the fixing parts becomes the air passage part.

4. The furnace according to claim 3, wherein the fixing part is a threaded fastening part.

5. The furnace according to claim 3, wherein the fixing part is an intermittent-welded part.

6. The furnace according to claim 1, wherein a through-hole formed member serving as the air passage part is disposed on the cover plate above the fixed molten metal surface level position.

* * * * *